US008237634B2

(12) United States Patent
Kwak

(10) Patent No.: US 8,237,634 B2
(45) Date of Patent: Aug. 7, 2012

(54) PIXEL AND ORGANIC LIGHT EMITTING DISPLAY DEVICE USING THE SAME

(75) Inventor: Won-Kyu Kwak, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 418 days.

(21) Appl. No.: 12/501,168

(22) Filed: Jul. 10, 2009

(65) Prior Publication Data

US 2010/0013816 A1 Jan. 21, 2010

(30) Foreign Application Priority Data

Jul. 18, 2008 (KR) ..... 10-2008-0070002

(51) Int. Cl.
*G09G 5/00* (2006.01)

(52) U.S. Cl. ..... 345/76; 345/211

(58) Field of Classification Search ..... 315/51, 315/169.3; 345/76, 204, 211
See application file for complete search history.

(56) References Cited

U.S. PATENT DOCUMENTS

| | | | | |
|---|---|---|---|---|
| 2003/0098657 | A1 | 5/2003 | Suzuki | |
| 2003/0103022 | A1 | 6/2003 | Noguchi et al. | |
| 2005/0052366 | A1 * | 3/2005 | Kim | 345/76 |
| 2008/0036704 | A1 * | 2/2008 | Kim et al. | 345/76 |

FOREIGN PATENT DOCUMENTS

| | | |
|---|---|---|
| EP | 1 887 553 A1 | 2/2008 |
| JP | 2000-347621 | 12/2000 |
| JP | 2002-244617 | 8/2002 |
| JP | 2003-186437 | 7/2003 |
| JP | 2006-309119 | 11/2006 |
| JP | 2006-309149 | 11/2006 |
| JP | 2007-133282 | 5/2007 |
| JP | 2008-040451 | 2/2008 |
| JP | 2008-158477 | 7/2008 |
| KR | 2003-0003446 | 1/2003 |
| KR | 10-2005-0104817 | 11/2005 |
| KR | 10-2006-0114456 | 11/2006 |
| KR | 10-2007-0083072 | 8/2007 |

OTHER PUBLICATIONS

European Search Report dated Oct. 16, 2009, for corresponding European application 09165757.7.

KIPO Office action dated Dec. 15, 2009, for priority Korean application 10-2008-0070002.

JP Office Action dated Jul. 5, 2011 issued in Japanese Patent Application No. 2009-001688, 4 pages.

* cited by examiner

*Primary Examiner* — Amare Mengistu
*Assistant Examiner* — Stacy Khoo
(74) *Attorney, Agent, or Firm* — Christie, Parker & Hale, LLP

(57) ABSTRACT

A pixel capable of improving response characteristics and displaying an image having a uniform image quality, and an organic light emitting display device using the same. The pixel includes an organic light emitting diode coupled between first power and second power; a pixel circuit coupled between the first power and the organic light emitting diode for supplying a driving current to the organic light emitting diode; and a first transistor for supplying a reset voltage to an anode electrode of the organic light emitting diode during a first period when a previous scan signal is supplied to a previous scan line.

7 Claims, 3 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2008-0070002, filed on Jul. 18, 2008, in the Korean Intellectual Property Office, the entire content of which is incorporated herein by reference.

BACKGROUND OF THE INVENTION

1. Field of the Invention

The present invention relates to a pixel and an organic light emitting display device using the same, and more particularly, to a pixel capable of improving response characteristics and displaying an image having a uniform image quality, and an organic light emitting display device using the same.

2. Description of Related Art

Recently, there have been developed various types of flat panel display devices having lighter weight and smaller volume than those of cathode ray tube display devices.

Among these flat panel display devices, an organic light emitting display device displays images by using organic light emitting diodes (OLEDs) which are self-luminescent elements, so that the luminance and color purity of displayed images are excellent. Accordingly, the organic light emitting display device has been in the spotlight as a next-generation display device.

Organic light emitting display devices are categorized into a passive matrix type organic light emitting display device (PMOLED) and an active matrix type organic light emitting display device (AMOLED), depending on a method of driving the organic light emitting diodes.

The AMOLED includes a plurality of pixels positioned at crossing regions of scan and data lines. Each of the pixels includes an organic light emitting diode and a pixel circuit for driving the organic light emitting diode. Here, the pixel circuit generally includes a switching transistor, a driving transistor, and a storage capacitor.

Since the AMOLEDs can operate with low power consumption, they are widely used in portable display devices and the like.

However, response characteristics of a pixel of the AMOLED may be adversely affected by parasitic capacitance generated due to the structure of the pixel, therefore, image quality of an image displayed by a plurality of such pixels may be uneven among the pixels.

For example, in a top-emission type AMOLED in which a pixel includes a pixel circuit and an organic light emitting diode that overlap with each other, a kickback voltage is generated by parasitic capacitance generated between a storage capacitor and an anode electrode of the organic light emitting diode.

The kickback voltage causes a voltage fluctuation at a node coupled to a gate electrode of a driving transistor. Furthermore, the variations of voltage fluctuations occur between frames displaying the same gray level, depending on the gray level of a previous frame. Therefore, response characteristics of a pixel may be worsened, and image quality of an image displayed may be degraded.

SUMMARY OF THE INVENTION

Accordingly, it is an aspect of the present invention to provide a pixel capable of improving response characteristics and displaying an image having a uniform image quality, and an organic light emitting display device using the same.

According to an embodiment of the present invention, a pixel includes: an organic light emitting diode coupled between a first power and a second power; a pixel circuit coupled between the first power and the organic light emitting diode for supplying a driving current to the organic light emitting diode; and a first transistor for supplying a reset voltage to an anode electrode of the organic light emitting diode during a first period when a previous scan signal is supplied to a previous scan line coupled to the first transistor.

Here, the reset voltage may be set as a voltage of an initialization power; and the first transistor may be coupled between the anode electrode of the organic light emitting diode and the initialization power, and a gate electrode of the first transistor may be coupled to the previous scan line.

Alternatively, the reset voltage may be set as a voltage of the second power; and the first transistor may be coupled between the anode electrode of the organic light emitting diode and the second power, and a gate electrode of the first transistor may be coupled to the previous scan line.

The pixel circuit may include a second transistor coupled between a data line and a first node, and having a gate electrode coupled to a current scan line; a third transistor coupled between the first node and the organic light emitting diode, and having a gate electrode coupled to a second node; and a first capacitor coupled between the second node and the first power. The pixel circuit may further include a fourth transistor coupled between the gate electrode of the third transistor and a drain electrode of the third transistor, and having a gate electrode coupled to the current scan line; a fifth transistor coupled between the first power and the first node, and having a gate electrode coupled to a light-emitting control line; a sixth transistor coupled between the third transistor and the organic light emitting diode, and having a gate electrode coupled to the light-emitting control line; and a seventh transistor coupled between the second node and the initialization power, and having a gate electrode coupled to the previous scan line.

According to another embodiment of the present invention, an organic light emitting display device includes: a plurality of pixels at crossing regions of scan lines, light-emitting control lines, and data lines, wherein each of the pixels includes: an organic light emitting diode coupled between a first power and a second power; a pixel circuit coupled between the first power and the organic light emitting diode for supplying a driving current to the organic light emitting diode; and a first transistor for supplying a reset voltage to an anode electrode of the organic light emitting diode during a first period when a previous scan signal is supplied to a previous scan line of the scan lines.

According to still another embodiment of the present invention, a method of driving a pixel of an organic light emitting display is provided. The pixel includes an organic light emitting diode coupled to a driving transistor. The pixel is coupled to a scan line, a previous scan line, a light-emitting control line, and a data line. The method includes: after a previous frame and prior to applying a scan signal to the scan line in a current frame, setting a voltage at an anode of the organic light emitting diode to a reset voltage; applying the scan signal to the scan line; applying a data signal to the data line; and applying a light-emitting signal to the light-emitting control line to enable the organic light emitting diode to emit light. The reset voltage remains substantially constant in the previous frame and the current frame.

In a pixel and an organic light emitting display device using the same according to the embodiments of the present invention, each pixel has a reset transistor (e.g., a first transistor) for applying a constant voltage to an anode electrode of an organic light emitting diode during an initialization period. Accordingly, the value of a kickback voltage is maintained constant for each gray level, regardless of the gray level displayed in a previous frame, so that response characteristics of the pixel can be improved, and an image having a uniform image quality can be displayed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
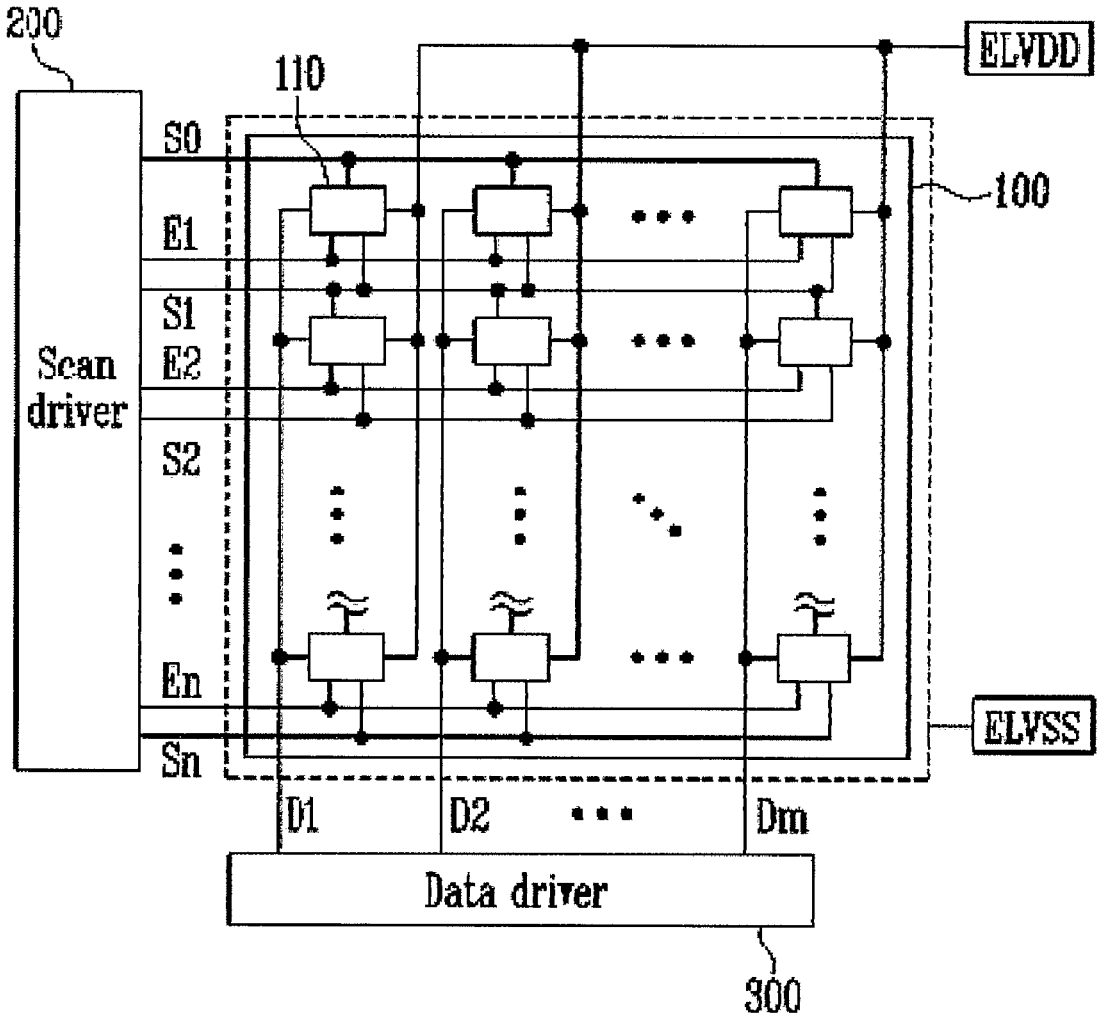
FIG. 1 is a block diagram schematically showing the configuration of an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the present invention are omitted for clarity. Also, like reference numerals refer to like elements throughout.

FIG. 1 is a block diagram schematically showing the configuration of an organic light emitting display device according to an embodiment of the present invention.

Referring to FIG. 1, the organic light emitting display device according to the embodiment of the present invention includes a display unit 100, a scan driver 200, and a data driver 300.

The display unit 100 includes a plurality of pixels 110 arranged in a matrix at crossing regions of scan lines S0 to Sn, light-emitting control lines E1 to En, and data lines D1 to Dm.

Each of the pixels 110 is coupled to a scan line (hereinafter, referred to as a "current scan line") and a light-emitting control line coupled to a row of the pixels 110 in which the pixel 110 itself is positioned, another scan line (hereinafter, referred to as a "previous scan line) coupled to a previous row of pixels 110, and a data line coupled to a column of pixels 110 in which the pixel 110 itself is positioned. For example, the pixel 110 positioned in an i-th row and a j-th column is coupled to an i-th scan line Si, an i-th light-emitting control line Ei, an (i−1)-th scan line Si−1 and a j-th data line Dj.

Each of the pixels 110 is initialized during a first period when a scan signal is supplied from the previous scan line, and receives a data signal supplied from the data line during a second period when a scan signal is supplied from the current scan line. The pixels 110 display an image by emitting light having a luminance corresponding to data signals during a third period when the voltage level of a light-emitting control signal supplied from the light-emitting control line is transitioned to a suitable level so that currents are supplied to organic light emitting diodes provided in the respective pixels 110.

Meanwhile, the display unit 100 receives externally supplied (e.g., from a power supply) first power ELVDD and second power ELVSS. The first power ELVDD and the second power ELVSS serve as a high-level voltage source and a low-level voltage source, respectively. The first power ELVDD and the second power ELVSS are used as driving power sources of the pixels 110.

The scan driver 200 generates a scan signal and a light-emitting control signal, corresponding to an externally supplied (e.g., from a timing control unit) scan control signal. The scan signal and the light-emitting control signal, generated by the scan driver 200, are sequentially supplied to the pixels 110 through the scan lines S0 to Sn and the light-emitting control lines E1 to En, respectively.

The data driver 300 generates data signals, corresponding to externally supplied (e.g., from the timing control unit) data and data control signal. The data signals generated by the data driver 300 are supplied to the pixels 110 through the data lines D1 to Dm in synchronization with the scan signal.

Figure 2:
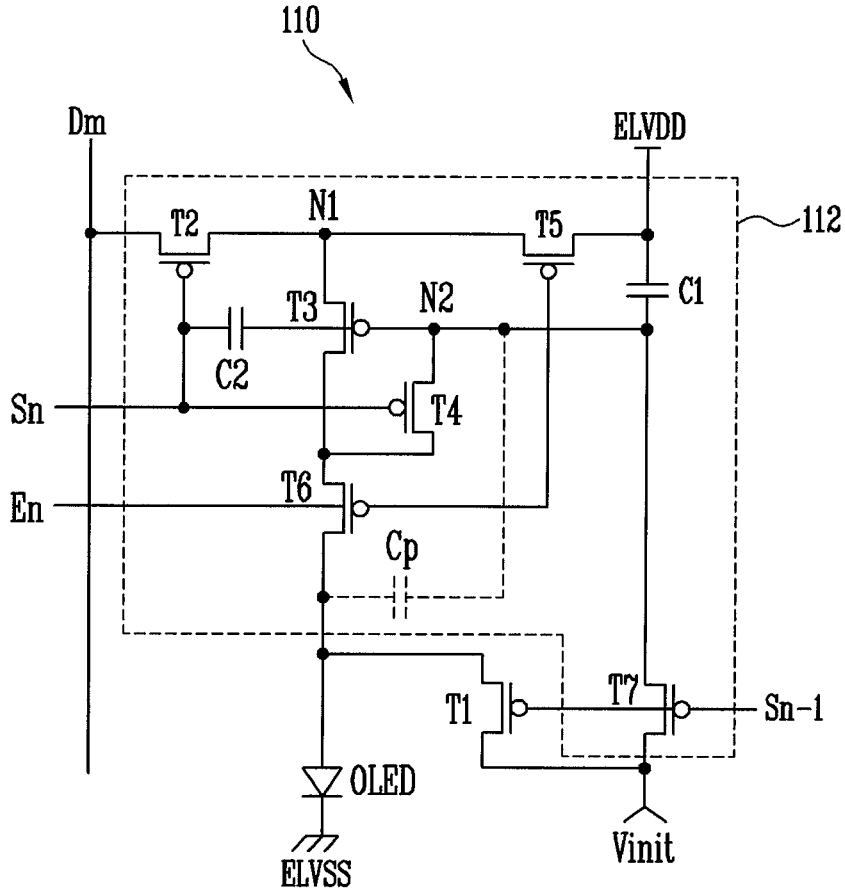
FIG. 2 is a schematic circuit diagram of a pixel according to an embodiment of the present invention.

FIG. 2 is a schematic circuit diagram of a pixel according to an embodiment of the present invention. The pixel shown in FIG. 2 may be applied to the organic light emitting display device shown in FIG. 1, and the like. For the convenience of illustration, FIG. 2 illustrates a pixel 110 positioned in an n-th row and an m-th column.

Referring to FIG. 2, the pixel 110 according to the embodiment of the present invention includes an organic light emitting diode OLED coupled between the first power ELVDD and the second power ELVSS; a first transistor T1 for supplying a reset voltage to an anode electrode of the organic light emitting diode OLED during a period when a previous scan signal is supplied to a previous scan line Sn−1; and a pixel circuit 112 coupled between the first power ELVDD and the organic light emitting diode OLED for supplying a driving current to the organic light emitting diode OLED.

Furthermore, the first transistor T1 is coupled between the anode electrode of the organic light emitting diode OLED and an initialization power Vinit. A gate electrode of the first transistor T1 is coupled to the previous scan line Sn−1. Here, the initialization power Vinit is a power source additionally supplied for initializing the pixel 110 as a separate power source different from the first power ELVDD and the second power ELVSS.

The first transistor T1 is turned on during a period when a previous signal (e.g., a previous scan signal) is supplied to the previous scan line Sn−1 so that the voltage of the initialization power Vinit is supplied to the anode electrode of the organic light emitting diode OLED.

That is, the first transistor T1 serves as a reset transistor for supplying a constant reset voltage to the anode electrode of the organic light emitting diode OLED during an initialization period of the pixel 110. In the embodiment shown in FIG. 2, the reset voltage is set as a voltage of the initialization power Vinit.

The pixel circuit 112 includes second to seventh transistors T2 to T7, and first and second capacitors C1 and C2.

The second transistor T2 is coupled between a data line Dm and a first node N1, and a gate electrode of the second transistor T2 is coupled to a current scan line Sn. The second transistor T2 is turned on during a period when a current scan signal is supplied to the current scan line Sn so as to supply a data signal supplied from the data line Dm to the pixel 110.

The third transistor T3 is coupled between the first node N1 and the organic light emitting diode OLED, and a gate electrode of the third transistor T3 is coupled to a second node N2. The third transistor T3 controls the amplitude of a driving current that flows to the organic light emitting diode OLED during a light-emitting period of the pixel 110, corresponding to the data signal supplied from the second transistor T2.

The fourth transistor T4 is coupled between the gate electrode of the third transistor T3 and a drain electrode of the third transistor T3, and a gate electrode of the fourth transistor T4 is coupled to the current scan line Sn. The fourth transistor T4 is turned on during the period when the current scan signal is supplied to the current scan line Sn so as to diode-couple the third transistor T3.

The fifth transistor T5 is coupled between the first power ELVDD and the first node N1, and a gate electrode of the fifth transistor T5 is coupled to a light-emitting control line En. When a light-emitting control signal supplied from the light-emitting control line En is transitioned to a low level, the fifth transistor T5 allows the first power ELVDD to be electrically coupled to the first node N1. That is, if the fifth transistor T5 is turned on, the third transistor T3 is electrically coupled to the first power ELVDD.

The sixth transistor T6 is coupled between the third transistor T3 and the organic light emitting diode OLED, a gate electrode of the sixth transistor T6 is coupled to the light-emitting control line En. The sixth transistor T6 is turned off during a period when a high-level light-emitting control signal is supplied to the light-emitting control line En, so that it is possible to prevent the driving current from being supplied to the organic light emitting diode OLED. The sixth transistor T6 is turned on during a light-emitting period when the voltage level of the light-emitting control signal is transitioned to a low level, so that the third transistor T3 is electrically coupled to the organic light emitting diode OLED.

The seventh transistor T7 is coupled between the second node N2 and the initialization power Vinit, and a gate electrode of the seventh transistor T7 is coupled to the previous scan line Sn−1. The seventh transistor T7 is turned on during the period when the previous scan signal is supplied to the previous scan line Sn−1, so that the voltage of the initialization power Vinit is supplied to the second node N2.

The first capacitor C1 is coupled between the second node N2 and the first power ELVDD. The first capacitor C1 is initialized by the initialization power Vinit supplied via the seventh transistor T7 during the period when the previous scan signal is supplied to the previous scan line Sn−1. Thereafter, a voltage corresponding to a data signal supplied via the second to fourth transistors T2 to T4 is stored in the first capacitor C1 during the period when the current scan signal is supplied to the current scan line Sn.

The second capacitor C2 is coupled between the second node N2 and the current scan line Sn. The second capacitor C2 allows a voltage difference between the current scan signal supplied from the current scan line Sn and the second node N2 to be constantly maintained. That is, when the voltage level of the current scan signal is changed, particularly at the time when the supply of the current scan signal is suspended, the second capacitor C2 increases the voltage at the second node N2 through a coupling operation, thereby compensating for a voltage drop caused by a load in a panel including the pixel 110.

The organic light emitting diode OLED is coupled between the pixel circuit 112 and the second power ELVSS. The organic light emitting diode OLED emits light corresponding to the driving current supplied via the first power ELVDD, the fifth transistor T5, the third transistor T3, and the sixth transistor T6 during the light-emitting period of the pixel 110.

In the pixel 110, a parasitic capacitance Cp exists between the second node N2 and the anode electrode of the organic light emitting diode OLED due to structural overlapping between the anode electrode of the organic light emitting diode OLED and the pixel circuit 112, particularly the first capacitor C1 and/or the second capacitor C2.

When a voltage at the anode electrode of the organic light emitting diode OLED (hereinafter, referred to as an "anode voltage") is changed, a kickback voltage is generated by the parasitic capacitance Cp, thereby changing the voltage at the second node N2.

Here, the kickback voltage increases as the variation of the anode voltage becomes larger. For example, when the organic light emitting diode OLED displays a black gray level in a previous frame and a white gray level in the subsequent frame, the anode voltage is rapidly increased while being changed from a very low state (e.g., a low voltage) to a high state (e.g., a high voltage) when the light-emitting period of the pixel 110 is started. Accordingly, a large kickback voltage is generated by the parasitic capacitance Cp, so that the voltage of the second node N2 is increased. Therefore, since the voltage at the second node N2 is not set sufficiently low to display the white gray level in a first frame in which the black gray level is changed into the white gray level, the driving current is decreased.

When the organic light emitting diode OLED displays a white gray level in both of the previous and subsequent frames, the anode voltage is set in a relatively high state in the previous frame (in embodiments in which the first transistor T1 is not provided). For this reason, a relatively small kickback voltage is generated.

Therefore, the driving current in the subsequent frame in which the white gray level is maintained is greater than that in the first frame in which the black gray level is changed into the white gray level, so that the organic light emitting diode OLED in the subsequent frame emits light having a higher luminance than that in the first frame.

That is, if the anode voltage is not reset in every frame, a luminance variation occurs for each frame depending on the luminance difference between a previous frame and a current frame although a data signal corresponding to the same gray level is supplied in both frames. Accordingly, the light-emitting luminance of the pixel 110 in the first frame in which a low gray level is changed into a high gray level is relatively lower than that of the pixel 110 in the subsequent frame in which the similar or same gray level is maintained. Thus, a step difference is generated on a luminance curve and shown in the form of a delay. Therefore, response characteristics of the pixel 110 may be worsened, and image quality may be unequal.

The first transistor T1 is provided for allowing the anode voltage to be constantly reset during an initialization period for each frame to prevent the above described problem.

Therefore, the value of the kickback voltage is maintained substantially constant for each gray level, regardless of the gray level of the data signal supplied in the previous frame. Accordingly, a step difference is prevented from being generated on a luminance curve, so that the response characteristics of the pixel 110 are improved, and an image having a uniform image quality is displayed.

Figure 3:
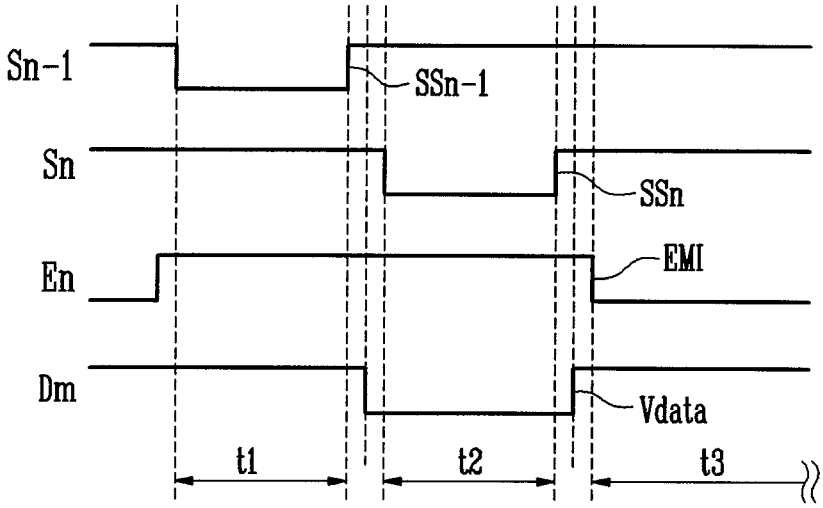
FIG. 3 is a waveform diagram for illustrating a method of driving the pixel shown in FIG. 2.

FIG. 3 is a waveform diagram for illustrating a method of driving the pixel shown in FIG. 2. For the convenience of illustration, a driving signal supplied to the pixel during one frame will be illustrated in FIG. 3. Hereinafter, a driving method of the pixel shown in FIG. 2 will be described in detail with reference to FIGS. 2 and 3.

Referring to FIG. 3, a low-level previous scan signal SSn−1 is first supplied to the pixel 110 during a first period t1 set as an initialization period. Therefore, the first and seventh transistors T1 and T7 are turned on by the low-level previous scan signal SSn−1. Accordingly, the voltage of the initialization power Vinit is provided to the anode electrode of the organic light emitting diode OLED and the second node N2. Here, the voltage of the initialization power Vinit may be set as a suitable value capable of initializing the pixel 110, e.g., a value lower than the minimum voltage of a data signal Vdata.

In the embodiment of the present invention shown in FIG. 2, the voltage of the initialization power Vinit is supplied as a reset voltage to the anode electrode of the organic light emitting diode OLED by the first transistor T1 during the first period t1, so that the anode voltage can be constantly reset in every frame.

Thereafter, a low-level current scan signal SSn is supplied to the pixel 110 during a second period t2 set as a programming period. Then, the second and fourth transistors T2 and T4 are turned on in response to the low-level current scan signal SSn. The third transistor T3 diode-coupled by the fourth transistor T4 is turned on. Since the second node N2 is initialized during the first period t1, the third transistor T3 is diode-coupled in a forward direction.

Therefore, the data signal Vdata supplied to the data line Dm is supplied to the second node N2 via the second to fourth transistors T2 to T4. At this time, since the third transistor T3 is diode-coupled, a voltage corresponding to a difference between the data signal Vdata and the threshold voltage of the third transistor T3 is supplied to the second node N2. The voltage supplied to the second node N2 is charged into the first capacitor C1.

Thereafter, if the voltage level of the current scan signal SSn is transitioned to a high level, the voltage at the second node N2 is changed corresponding to the voltage variation of the current scan signal SSn through a coupling operation via the second capacitor C2.

Thereafter, a light-emitting control signal EMI is transitioned to a low level during a third period t3 set as a light-emitting period. Then, the fifth and sixth transistors T5 and T6 are turned on by the low-level light-emitting control signal EMI. Therefore, a driving current flows along a path from the first power ELVDD via the fifth transistor T5, the third transistor T3, the sixth transistor T6 and the organic light emitting diode OLED to the second power ELVSS.

Here, the third transistor T3 controls the amplitude of the driving current in response to a voltage supplied to the gate electrode of the third transistor T3, i.e., a voltage at the second node N2.

Meanwhile, since the voltage corresponding to the threshold voltage of the third transistor T3 is stored into the first capacitor C1 during the second period t2, the threshold voltage of the third transistor T3 is compensated for during the third period t3.

Further, the anode voltage is reset to a constant reset voltage during the first period t1 for each frame. For this reason, although a kickback voltage is generated due to the variation of the anode voltage during the third period t3, the value of the kickback voltage is maintained constant for all gray levels, regardless of the gray level of the data signal supplied in the previous frame.

Figure 4:
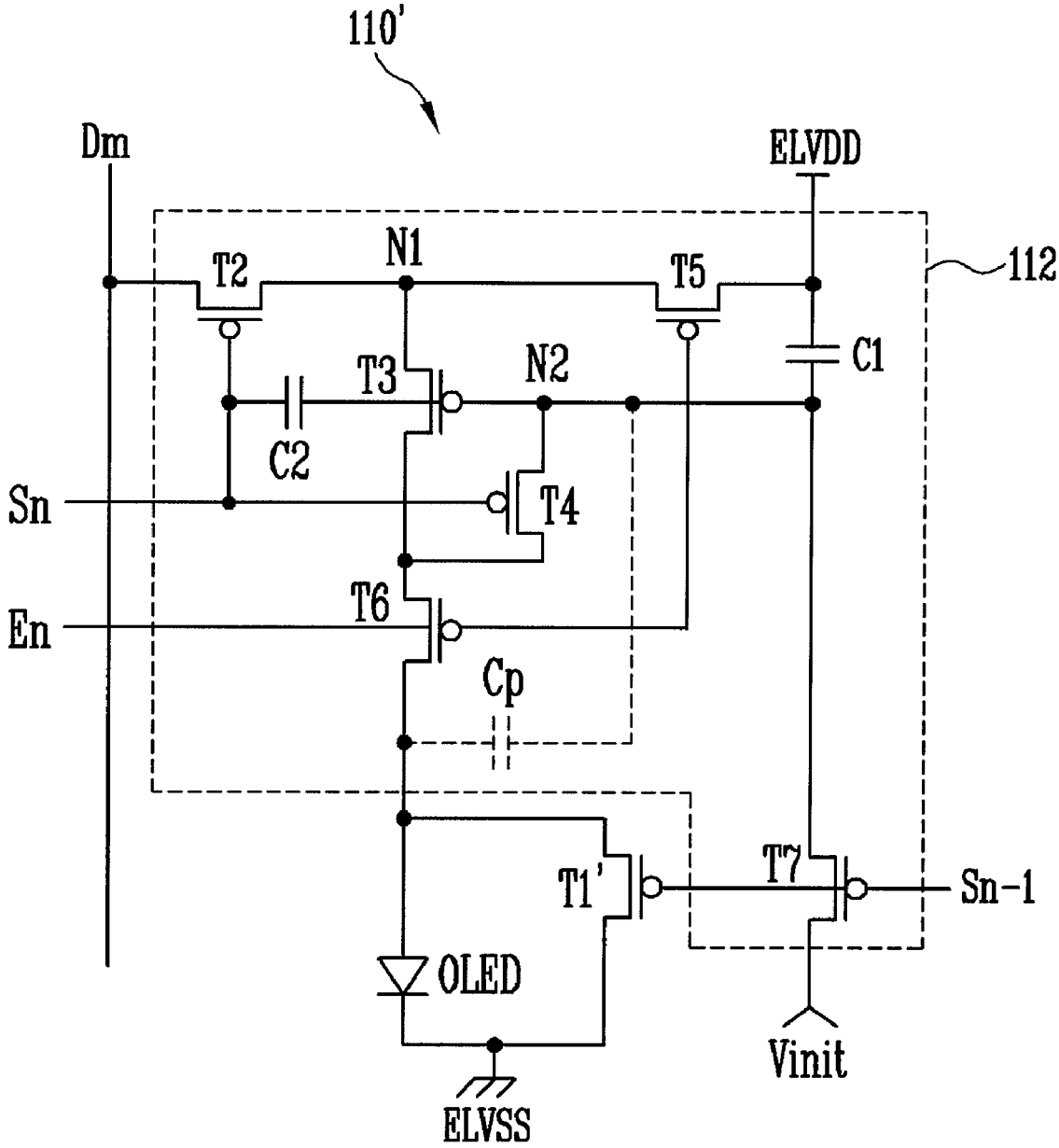
FIG. 4 is a schematic circuit diagram of a pixel according to another embodiment of the present invention.

FIG. 4 is a circuit diagram of a pixel according to another embodiment of the present invention. In FIG. 4, like reference numerals are assigned to like elements corresponding to those of FIG. 2, and their detailed descriptions will be omitted.

Referring to FIG. 4, in the pixel 110', a first transistor T1' is coupled between an anode electrode of an organic light emitting diode OLED and a second power ELVSS. That is, in this embodiment, a reset voltage for resetting an anode voltage is set as the voltage of the second power ELVSS. If the reset voltage is set as the voltage of the second power ELVSS, a large kickback voltage is generated, and the increment of a voltage at a second node N2 is increased. Accordingly, a gray level can be easily expressed at a low gray level (e.g., a black gray level).

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel of an organic light emitting display device comprising:

an organic light emitting diode coupled between a first power and a second power;

a pixel circuit coupled between the first power and the organic light emitting diode for supplying a driving current to the organic light emitting diode; and a first transistor for supplying a reset voltage to an anode electrode of the organic light emitting diode during a first period when a previous scan signal is supplied to a previous scan line coupled to the first transistor, wherein the pixel circuit comprises:

a second transistor coupled between a data line and a first node and having a gate electrode coupled to a current scan line;

a third transistor coupled between the first node and the organic light emitting diode and having a gate electrode coupled to a second node;

a first capacitor coupled between the second node and the first power;

a fourth transistor coupled between the gate electrode of the third transistor and a drain electrode of the third transistor, and having a gate electrode coupled to the current scan line;

a fifth transistor coupled between the first power and the first node, and having a gate electrode coupled to a light-emitting control line;

a sixth transistor coupled between the third transistor and the organic light emitting diode, and having a gate electrode coupled to the light-emitting control line; and a seventh transistor coupled between the second node and an initialization power, and having a gate electrode coupled to the previous scan line.

2. The pixel as claimed in claim 1, wherein:

the reset voltage is a voltage of separate initialization power; and the first transistor is coupled between the anode electrode of the organic light emitting diode and the initialization power, and a gate electrode of the first transistor is coupled to the previous scan line.

3. The pixel as claimed in claim 1, wherein:

the reset voltage is a voltage of the second power; and the first transistor is coupled between the anode electrode of the organic light emitting diode and the second power, and a gate electrode of the first transistor is coupled to the previous scan line.

4. The pixel as claimed in claim 1, wherein the pixel circuit further comprises a second capacitor coupled between the second node and the current scan line.

5. An organic light emitting display device comprising a plurality of pixels at crossing regions of scan lines, light-emitting control lines, and data lines, each of the pixels comprising:

an organic light emitting diode coupled between a first power and a second power;

a pixel circuit coupled between the first power and the organic light emitting diode for supplying a driving current to the organic light emitting diode; and a first transistor for supplying a reset voltage to an anode electrode of the organic light emitting diode during a first period when a previous scan signal is supplied to a previous scan line of the scan lines, wherein the pixel circuit comprises:

a second transistor coupled between a data line of the data lines and a first node and having a gate electrode coupled to a current scan line of the scan lines;

a third transistor coupled between the first node and the organic light emitting diode and having a gate electrode coupled to a second node;

a first capacitor coupled between the second node and the first power;

a fourth transistor coupled between the gate electrode of the third transistor and a drain electrode of the third transistor, and having a gate electrode coupled to the current scan line;

a fifth transistor coupled between the first power and the first node, and having a gate electrode coupled to a light-emitting control line of the light-emitting control lines;

a sixth transistor coupled between the third transistor and the organic light emitting diode, and having a gate electrode coupled to the light-emitting control line; and a seventh transistor coupled between the second node and an initialization power, and having a gate electrode coupled to the previous scan line.

6. The organic light emitting display device as claimed in claim 5, wherein:

the reset voltage is a voltage of separate initialization power; and the first transistor is coupled between the anode electrode of the organic light emitting diode and the initialization power, and a gate electrode of the first transistor is coupled to the previous scan line.

7. The organic light emitting display device as claimed in claim 5, wherein:

the reset voltage is a voltage of the second power; and the first transistor is coupled between the anode electrode of the organic light emitting diode and the second power, and a gate electrode of the first transistor is coupled to the previous scan line.

* * * * *